United States Patent [19]

Bayer et al.

[11] 4,280,552

[45] Jul. 28, 1981

[54] DRIVING ROLL STAND FOR A CONTINUOUS CASTING PLANT

[75] Inventors: Franz Bayer; Hermann Schubert, both of Linz; Franz Kagerhuber, Traun, all of Austria

[73] Assignee: Voest-Alpine Aktiengesellschaft, Linz, Austria

[21] Appl. No.: 49,909

[22] Filed: Jun. 19, 1979

[30] Foreign Application Priority Data

Jun. 23, 1978 [AT] Austria ..... 4578/78

[51] Int. Cl.[3] ..... B22D 11/128

[52] U.S. Cl. ..... 164/448; 72/245

[58] Field of Search ..... 164/448, 442, 270, 417; 193/35 R; 226/189; 72/245

[56] References Cited

U.S. PATENT DOCUMENTS

| | | | |
|---|---|---|---|
| 3,543,555 | 12/1970 | Baumann et al. | 164/448 X |
| 3,628,594 | 12/1971 | Reinfeld et al. | 164/270 |
| 3,746,076 | 7/1973 | Baumann | 164/442 X |
| 4,106,550 | 8/1978 | Tsuchida | 164/448 |

FOREIGN PATENT DOCUMENTS

| | | | |
|---|---|---|---|
| 236045 | 2/1964 | Austria . | |
| 661958 | 8/1965 | Belgium | 164/448 |
| 1221402 | 7/1966 | Fed. Rep. of Germany | 164/448 |
| 1807709 | 6/1970 | Fed. Rep. of Germany | 164/448 |
| 1758398 | 5/1974 | Fed. Rep. of Germany . | |
| 1038169 | 8/1966 | United Kingdom | 164/448 |

*Primary Examiner*—R. L. Spruill
*Assistant Examiner*—J. Reed Batten, Jr.
*Attorney, Agent, or Firm*—Brumbaugh, Graves, Donohue & Raymond

[57] ABSTRACT

A driving roll stand to be used in a continuous casting plant includes a lower roll and an upper roll arranged one above the other. At least one of the rollers is drivable by a rotary drive. The lower roll is mounted at a support supported on a base, and the upper roll is mounted at a lever hinged to the support and pivotably movable by an adjustment drive. The adjustment drive is hinged both to an upper part of the support rising above the lever in height and to the lever. Further the rotary drive of the upper and/or lower roll is mounted at this upper part of the support.

3 Claims, 4 Drawing Figures

DRIVING ROLL STAND FOR A CONTINUOUS CASTING PLANT

BACKGROUND OF THE INVENTION

The invention relates to a driving roll stand for a continuous casting plant, in particular a multi-strand continuous casting plant for billets, comprising two rolls arranged one above the other, at least one of which is drivable by means of a rotary drive. The lower roll is mounted on a support supported on a base, and the upper roll is mounted on a lever hinged to the support and pivotably movable by means of an adjustment drive.

A driving roll stand of this kind is known from German Auslegeschrift No. 1,758,398. There, a separate pressure-medium cylinder is provided at each side of the stand for the pivotal movement of the lever at the height of the strand guideway, which pressure-medium cylinders, on the one hand, are hinged to the lever and, on the other hand, are hinged to the base plate of the support. The rotary drive for the upper roll is supported at one of the necks of the upper roll.

The arrangement of the two pressure-medium cylinders laterally beside the strand guideway, in addition to causing a relatively great width of the stand, necessitates the provision of heat protection shields. The utilization of this known construction with multi-strand continuous casting plants, in which there exists the problem of guiding the strands as closely adjacent as possible, is unfavorable because of the great width and because of the poor accessibility to the pressure-medium cylinders. In particular, it is possible only with great difficulty to exchange a pressure-medium cylinder at several driving roll stands arranged close to one another, or to repair the same, since manipulations have to be carried out between the driving roll stands while they continue to be in operation. A further disadvantage of this known construction is to be seen in that the total weight of the rotary drive has to be accommodated by the neck of the roll, which constitutes a great strain on the bearings of the driving rolls. The slight distance between the rotary drive and the strand, owing to the rotary drive being directly arranged at the neck of the roll, makes it necessary to provide a heat shield.

Moreover, it is known to adjust the pivotable lever of the driving roll stand by means of only a single pressure-medium cylinder laterally arranged. The disadvantages of such a design are to be seen in the fact that, because of the eccentrically active cylinder force the pivotable lever of the driving roll stand is torsionally strained, and thus has to be constructed to be accordingly stiff so as to resist torsion. The torsion-stiff design of the lever, however, requires it to be heavily constructed. Besides, it is not ensured with this construction that the rolls are exactly parallel.

SUMMARY OF THE INVENTION

The invention aims at avoiding these disadvantages and difficulties and has as its object to provide a driving roll stand of the initially-defined kind in which the adjustment drive and the rotary drive can be arranged at a location removed from the heavily heat-influenced zone, and in which a narrow, space-saving mode of construction can be realized. Repair of the adjustment drive, as well as the rotary drive, is to be feasible without impediment by the radiant heat of neighbouring strands that continue to be cast without interruption.

These objects are achieved according to the invention in that the adjustment drive is hinged, on the one hand, to an upper part of the support rising above the lever in height, and, on the other hand, to the lever. Also the rotary drive of the upper and/or lower roll is mounted at this upper part of the support.

It is advantageous, if, as an adjustment drive, a single pressure-medium cylinder is provided that is arranged centrally above the axis of the strand guideway, which results in a particularly simple construction. Also the pressure-medium cylinders can be used more effectively than those of the known construction since a pressure-medium can thus be admitted, for adjustment of the rolls, to the total piston face and not only - as it is the case with the known construction - to the piston face reduced by the cross-sectional face of the piston rod.

According to a preferred embodiment, the support comprises a base plate, in whose center the lower roll is mounted, as well as first and second struts arranged at a distance from the lower roll and opposite each other, which struts are directed upwardly approximately at a right angle to the base plate. A lever is hinged to the first strut and extends over to the oppositely arranged second strut, which lever supports the upper roller at its middle. Further the adjustment drive is hinged both to the end of the lever elongated beyond the upper roll toward the second strut as well as to the upper part of the second strut rising above this end of the lever in height. This construction has the advantage that, for adjusting the rolls, only relatively low forces and accordingly lighter dimensioned adjustment drives are required, due to the lever being designed so as to be elongated beyond the upper roll and toward the second strut.

A further preferred embodiment is characterized in that the support is designed in a C-shaped manner, wherein the lower roll is mounted at the free end of the lower horizontal part, the lever is hinged to the central perpendicular part, and the adjustment drive as well as the rotary drive are arranged at the horizontal upper part of the support. This configuration of the drive means has proved particularly advantageous for plants in which space has to be saved not only transversely to the axis of the strand guideway, but also in the direction of this axis.

BRIEF DESCRIPTION OF THE DRAWINGS

The invention will now be explained in more detail by way of two embodiments schematically illustrated in the drawings, wherein.

DESCRIPTION OF ILLUSTRATIVE EMBODIMENTS

Figure 1:
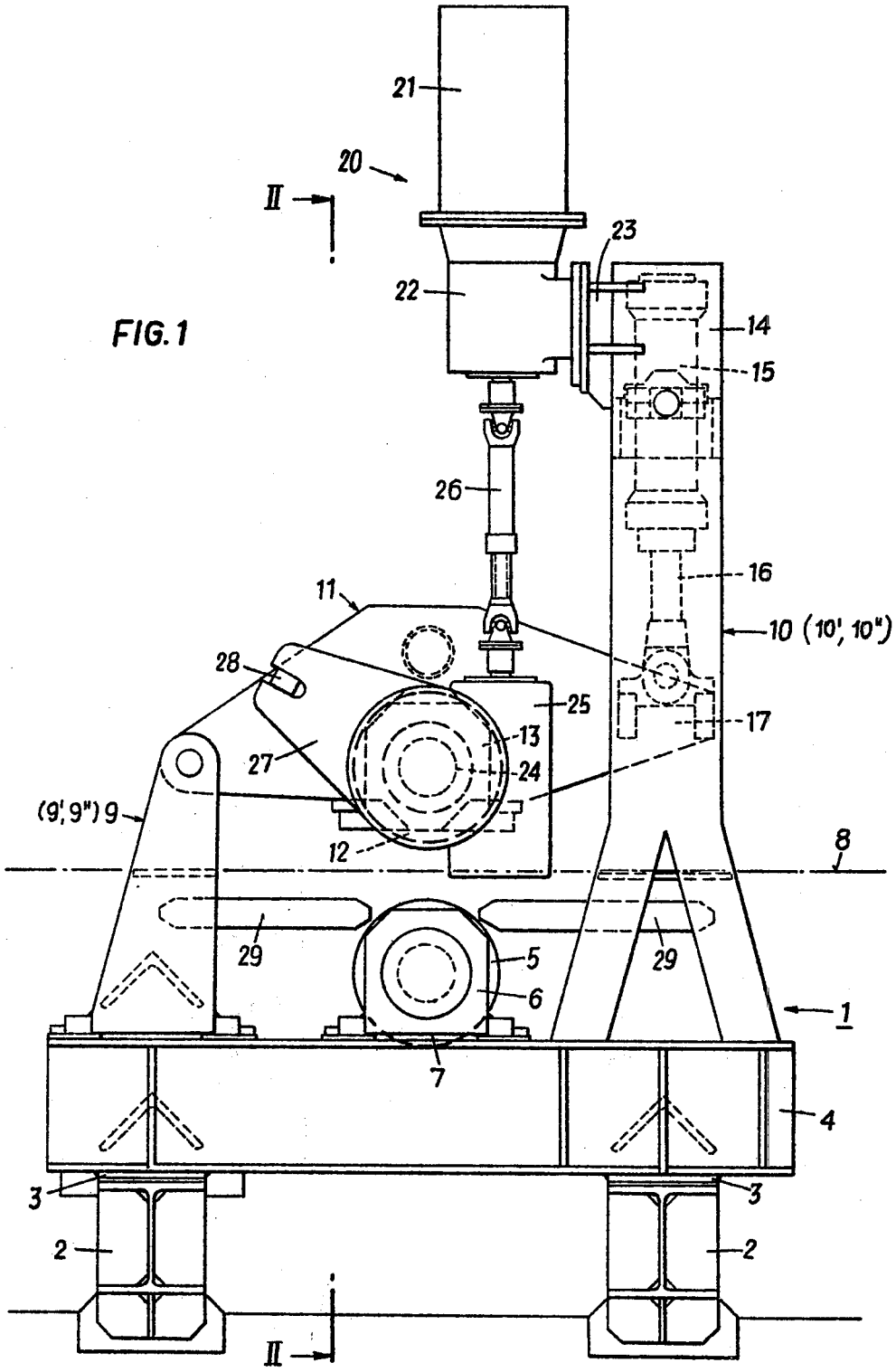
FIG. 1 is a side view of the driving roll stand according to one embodiment, at a right angle to the strand guideway.
Figure 2:
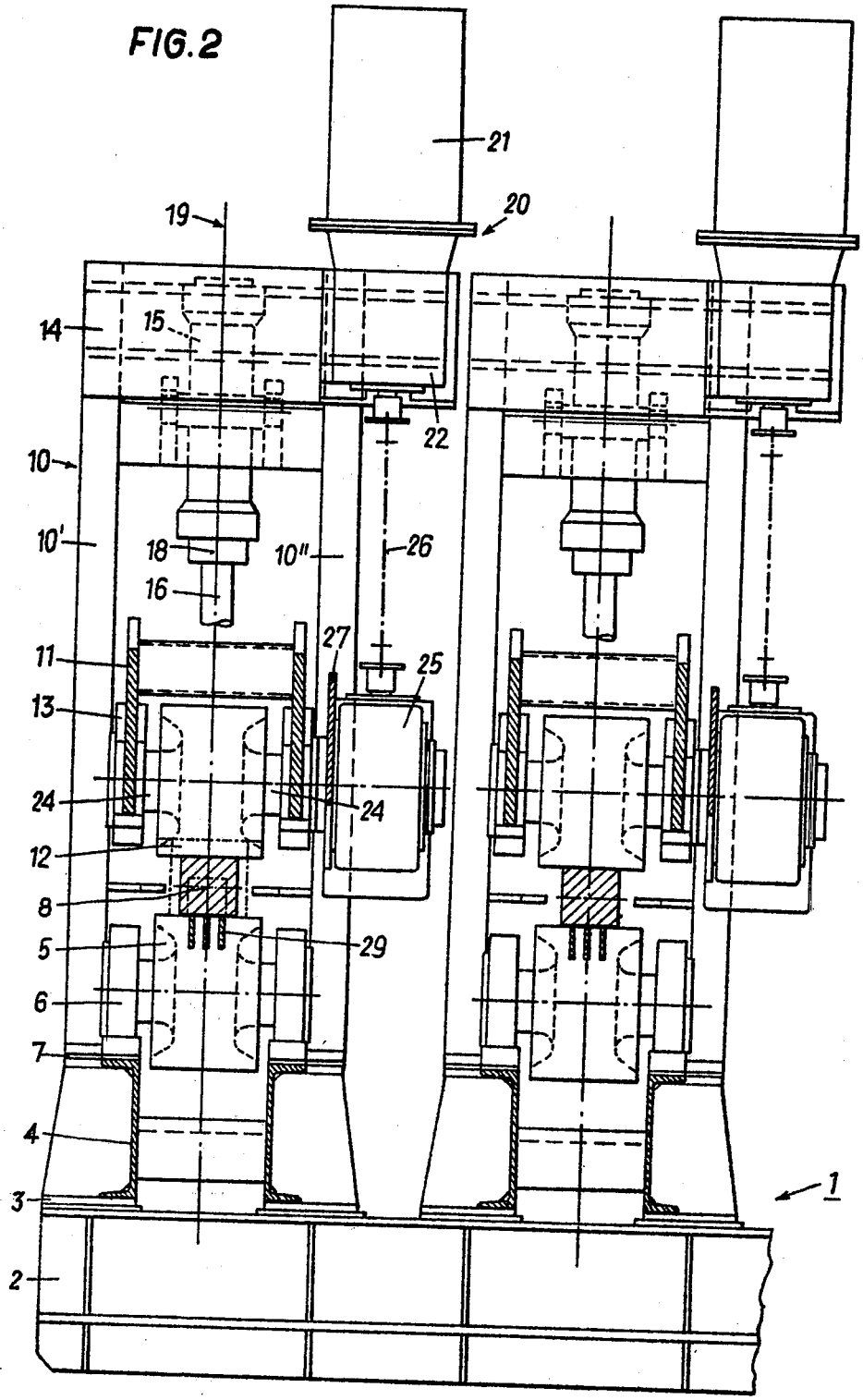
FIG. 2 illustrates a section along line II—II of FIG. 1.

The driving roll stand illustrated in FIGS. 1 and 2, of a multi-strand continuous casting plant for billets, comprises a support 1 mounted on girders 2 anchored on a base and serving for fastening several adjacently arranged supports. Shims 3 between the support 1 and the girders 2 serve for adjusting the driving roll stand. The support 1 comprises a horizontal carrying construction 4, which may be seen as the base plate of the support 1 and in whose center a lower roll 5 is rotatably mounted via supporting brackets 6. Adjustment of the roll or balancing out of a worn roll is effected by spacers 7 provided between the base plate 4 and the supporting brackets 6. At a distance from each other in the direction of the axis 8 of the strand guideway (illustrated by dot-and-dash lines) two oppositely arranged struts 9, 10, which are directed upwards approximately at a right angle to the base plate, are provided. Each strut, as can be seen from FIG. 2, is formed of two congruent plates 9', 9'', and 10', 10'', respectively, arranged laterally of the axis of the strand guideway. To the upper end of the strut 9 a lever 11, reaching as far as to the opposite strut 10, is hinged, on which lever the upper roll 12 situated opposite the lower roll 5 is rotatably mounted via supporting brackets 13. At the strut 10, which rises above the lever 11 in terms of height, a pressure-medium cylinder 15 is hinged to the upper part 14. The piston rod 16 of pressure-medium cylinder 15 is articulately connected with the end 17 of the lever 11. This pressure-medium cylinder 15, as can be seen particularly from FIG. 2, with its longitudinal axis 18, is arranged in the vertical plane 19 laid through the axis 8 of the strand guideway so that the lever 11 will not be strained torsionally by the pressure-medium cylinder 15, the lever thus being designable as simply as possible with regard to its shape.

Instead of the pressure-medium cylinder 15, it would also be possible to provide adjustment drive means of another design, for instance a drive means comprising a threaded spindle or a toothed rack.

At the upper end part of the strut 10, a rotary drive 20 for the upper roll 12, comprising an electro-motor 21 and a gear 22, is fastened via a console 23. One of the roll stubs 24 of the upper roll 12 is elongated beyond the supporting bracket 13 and carries a slip-on gear 25 - preferably a worm gear - which is connected with the rotary drive 20 via a telescoping articulation shaft 26, i.e. a shaft which may be changed in length and allows for angular excursions. The casing of the slip-on gear 25 comprises a torque support 27 which is supported at a block 28 fastened to the lever 11. Between the two congruent plates 9', 9'', and 10', 10'', respectively, of each strut 9, 10, horizontally arranged guide plates 29 are mounted for guiding the starter bar.

As can be seen from FIGS. 1 and 2, neither the rotary drive 20 nor the adjustment drive 15 is jeopardized by the heat of the cast strand, since both parts are arranged outside the dangerous radiation area. Repair of the adjustment drive 15 can be carried out without difficulties and in particular without any manipulations in the immediate radiation area of the strand billets of neighbouring driving roll stands, even with closely adjacent driving roll stands, as they are illustrated in FIG. 2.

Figure 3:
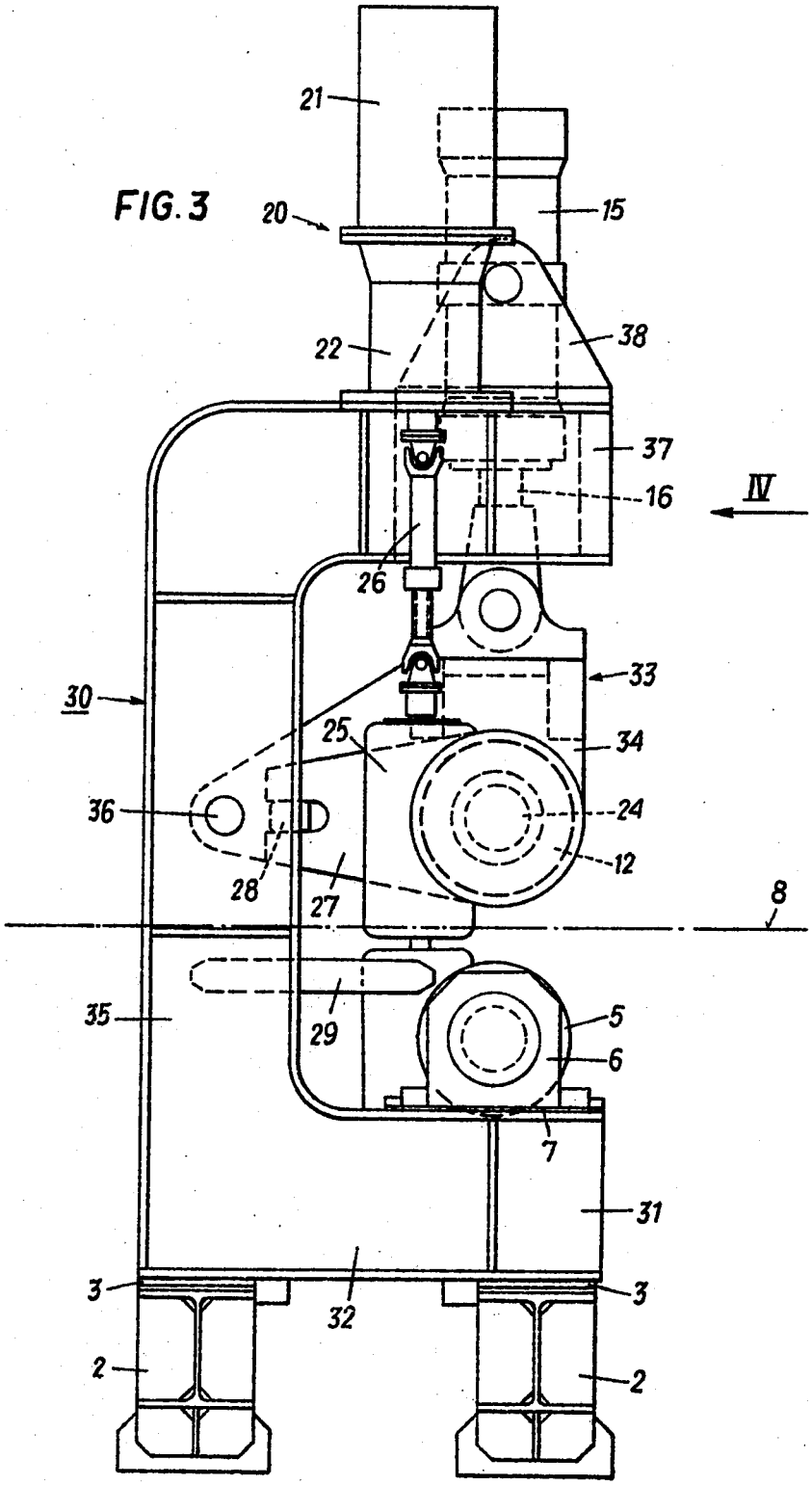
FIG. 3 is a side view of the second embodiment of the driving roll stand.
Figure 4:
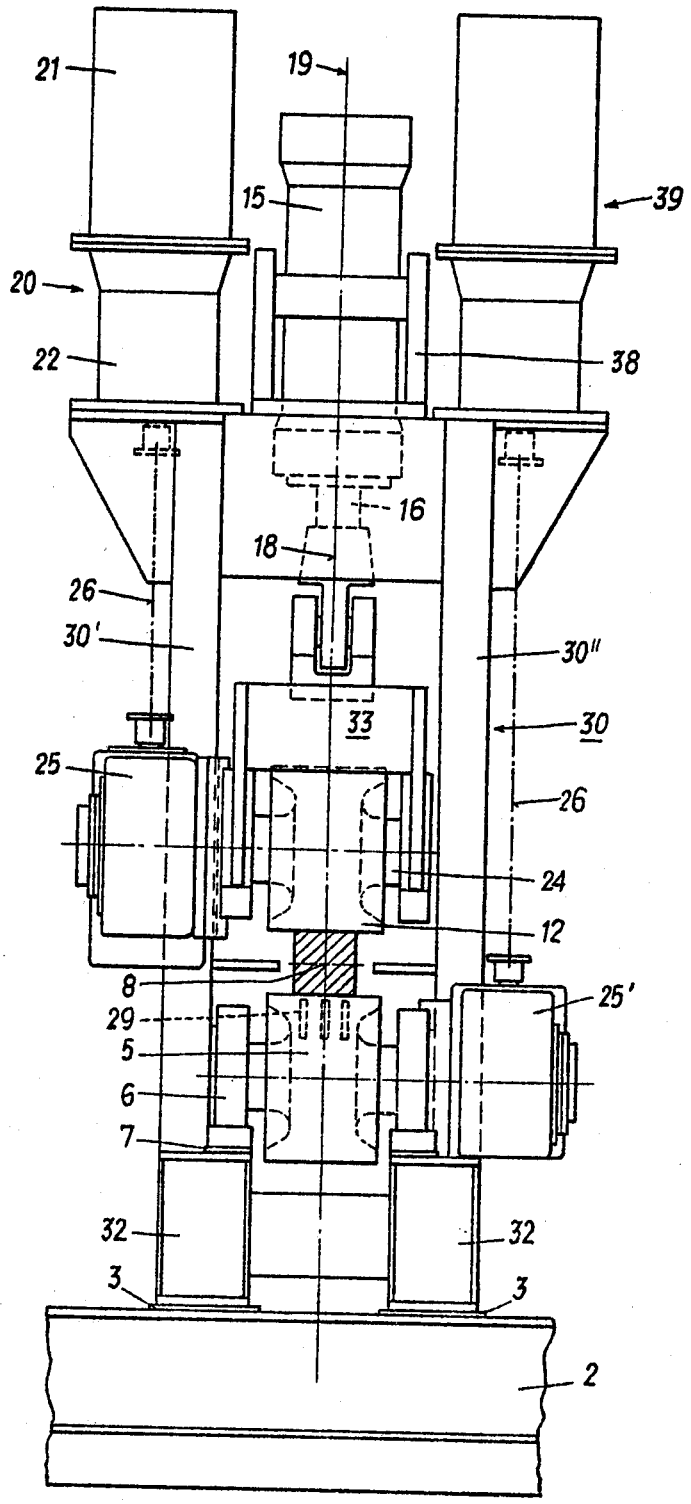
FIG. 4 illustrates a view in the direction of the arrow 4 of FIG. 3.

The driving roll stand illustrated in FIGS. 3 and 4 comprises a support 30 formed of two congruent standards 30', 30'' which, in the side view, are C-shaped. The lower roll is mounted at the free end 31 of the lower horizontal part 32 of the support. The lever 33, at whose free end 34 the upper roll 12 is mounted, is mounted at the central vertical part 35 so as to be pivotably movable about a bolt 36. To the horizontal upper part 37 of the C-shaped support 30, the pressure-medium cylinder 15 is hinged via consoles 38, the piston rod 16 of this pressure-medium cylinder being hinged to the end 34 of the pivotably movable lever 33, which carries the upper roll 12. The rotary drive 20, comprises electro-motor 21 and a gear 22, is also mounted on the horizontal upper part 37 of the support and is in active connection with a gear 25 slipped onto the roll neck 24 of the upper roll 12, via a telescoping articulation shaft 26. In this embodiment, the lower roll 5 is also drivable by means of a rotary drive 39, which is also mounted at the horizontal upper part 37 of the support 30. The advantage of this embodiment rests in the particularly short constructional form in the direction of the axis 8 of the strand guideway.

The invention is not limited to the embodiments illustrated in the drawings, but can be modified in various ways. Thus, the principle of the driving roll stands described can be applied also to driving roll stands at continuous casting plants for blooms or slabs.

What we claim is:

1. In a driving roll stand to be used in a continuous casting plant, for example a multi-stand continuous casting plant with strand guideways for billets, of the type including a lower roll and an upper roll arranged one above the other, a rotary drive for driving at least one of said rolls, a base, a support mounted on said base and supporting said lower roll, a lever hinged to said support and supporting said upper roll, and an adjustment drive for pivotably moving said lever, the improvement which is characterized in that, said support includes an upper part rising above said lever in terms of height, one end of said adjustment drive is hinged to said upper part of said support and the other end is hinged to said lever, said adjustment drive being a single device and means mounting said device centrally above the axis of said strand guideway, and said rotary drive is mounted at said upper part of said support.

2. In a driving roll stand to be used in a continuous casting plant, for example a multi-strand continuous casting plant with strand guideways for billets, of the type including a lower roll and an upper roll arranged one above the other, a rotary drive for driving at least one of said rolls, a base, a support mounted on said base and supporting said lower roll, a lever hinged to said support and supporting said upper roll, and an adjustment drive for pivotably moving said lever, the improvement which is characterized in that, said support includes an upper part rising above said lever in terms of height, one end of said adjustment drive is hinged to said upper part of said support and the other end is hinged to said lever, said rotary drive is mounted at said upper part of said support, and said support includes a base plate with said lower roll being mounted toward its center and first and second struts arranged opposite each other at a distance from said lower roll and being directed upwards at an approximately right angle to said base plate, and said upper roll is mounted toward the center of said lever, said lever having one end hinged to the end of said first strut and the other end extending beyond said upper roll to reach to said second strut, said second strut including the upper part rising above said lever in terms of height, said adjustment drive having its ends hinged to said other lever end and to said second-strut upper part.

3. In a driving roll stand to be used in a continuous casting plant, for example a multi-strand continuous casting plant with strand guideways for billets, of the type including a lower roll and an upper roll arranged one above the other, a rotary drive for driving at least one of said rolls, a base, a support mounted on said base and supporting said lower roll, a lever hinged to said support and supporting said upper roll, and an adjustment drive for pivotably moving said lever, the improvement which is characterized in that, said support includes an upper part rising above said lever in terms of height, one end of said adjustment drive is hinged to said upper part of said support and the other end is hinged to said lever, said rotary drive is mounted at said upper part of said support, and said support is designed to be C-shaped, including a lower horizontal part having a free end, a central perpendicular part, and a horizontal upper part, and said lower roll is mounted toward said free end of said lower horizontal part, said lever is hinged to said central perpendicular part, and said adjustment drive and said rotary drive are arranged at said horizontal upper part which rises above said lever in terms of height.

* * * * *